United States Patent [19]

Durbin et al.

[11] 4,265,486

[45] May 5, 1981

[54] APPARATUS FOR IN-SITU RETORTING

[75] Inventors: Anthony T. Durbin, Didcot, England; Bruce A. Kennedy, Golden, Colo.

[73] Assignees: Gulf Oil Corporation, Pittsburgh, Pa.; Standard Oil Company, Chicago, Ill.

[21] Appl. No.: 68,228

[22] Filed: Aug. 20, 1979

[51] Int. Cl.[3] ..... E21F 5/00; E21F 17/00

[52] U.S. Cl. ..... 299/2; 299/12; 299/19; 98/50

[58] Field of Search ..... 299/2, 19, 12; 98/50

[56] References Cited

U.S. PATENT DOCUMENTS

| | | | |
|---|---|---|---|
| 893,988 | 7/1908 | Durack | 299/19 |
| 982,095 | 1/1911 | Scheiler | 299/19 X |
| 2,621,725 | 12/1952 | Shacikoski | 98/50 |
| 2,855,757 | 10/1958 | Meade | 299/19 X |
| 4,009,649 | 3/1977 | Thimons et al. | 299/19 X |
| 4,036,024 | 7/1977 | Dreker et al. | 299/12 X |
| 4,143,917 | 3/1979 | Sweany | 299/2 |
| 4,153,299 | 5/1979 | Kvapil et al. | 299/19 X |
| 4,153,300 | 5/1979 | Kvapil et al. | 299/19 X |

*Primary Examiner*—Stephen J. Novosad

[57] ABSTRACT

Apparatus for the in-situ retorting of carbonaceous deposits includes a plurality of retorts connected to a common exhaust tunnel effectively free of broken shale into which products of the retorting are discharged. To allow simultaneous mining, rubblization and retorting of the in-situ retorts, the exhaust tunnel is provided with doorways between the retorts. Doors movable in the exhaust tunnel are adapted to seal against the doorways to prevent flow from retorts in which retorting is in progress to retorts under construction. A trench in the exhaust tunnel is provided for flow of liquid products produced in the retorting. A liquid seal under the doorways communicates with the trench to provide a passage for liquid flow past the doorways and to prevent upstream flow of gaseous products through the passage for the liquid flow.

15 Claims, 8 Drawing Figures

APPARATUS FOR IN-SITU RETORTING

BACKGROUND OF THE INVENTION

1. Field of the Invention

This invention relates to the in-situ retorting of carbonaceous deposits, and more particularly to apparatus for control of the flow of products produced during the in-situ retorting of such deposits.

2. Description of the Prior Art

Very large potential sources of fluid fuels exist in subsurface deposits of carbonaceous materials that are either solid materials or so highly viscous that they cannot be made to flow through the subsurface formation to a production well. Among such deposits are oil shale, tar sands and coal. One method of producing fluid fuels from such deposits is to ignite the deposits and continue after ignition to inject an oxygen-containing gas, usually air, into the deposits to burn some of the carbonaceous material. If an in-situ combustion process is utilized for production of shale oil from oil shale, the shale is heated to a temperature at which kerogen in the oil shale is converted to shale oil which is then made to flow to facilities for lifting the shale oil to the surface. In-situ combustion of tar sands raises the temperature of the sands to a temperature at which the oil has a viscosity sufficiently low to allow it to flow to production facilities. Cracking of the oil further reduces its viscosity, and the pressure of the injected air drives the oil toward the production well. The maintenance of combustion in coal deposits is designed principally to convert carbon in the coal to gaseous materials, principally carbon monoxide, which can be used as a fuel.

Shale deposits, coal deposits, and some of the tar sands have a permeability that is so low that even if the carbonaceous material is converted to fluids, flow to a production facility at a rate high enough to continue the combustion cannot be maintained. One method that has been proposed to overcome the low permeability of the carbonaceous deposit is to form rubblized in-situ retorts of the carbonaceous deposit. Several suitable processes for the formation of rubblized in-situ retorts and the production of fluid fuels therefrom are described in U.S. Pat. No. 1,919,636 of S. N. Karrick, U.S. Pat. No. 3,001,776 of H. K. Van Poollen and U.S. Pat. No. 2,481,051 of L. C. Uren. Rubblized retorts can be used for in-situ combustion processes and also for other retorting schemes such as injection of hot flue gases or steam into the retort.

In the systematic exploitation of a subsurface deposit of a material such as oil shale, retorts are constructed in rows and retorting of rubblized shale is conducted in one or more of the retorts in the row while construction of other rubblized retorts in the row is proceeding. The gaseous products produced in the in-situ combustion operations are highly toxic. It is important to isolate retorts under construction from retorts in which combustion is in progress. In a preferred method of preventing flow of combustion products from a retort in which combustion is in progress through fissures or fractures in the carbonaceous deposit to a retort in which men are working, a rubblized retort between the combustion and mining retorts is maintained under air pressure higher than the pressure in both the retorts in which combustion is in progress and the retorts in which men are working.

SUMMARY OF THE INVENTION

This invention resides in an exhaust tunnel and a movable door structure serving a plurality of in-situ retorts. The exhaust tunnel is for delivery of products produced during in-situ retorting to collection and lifting apparatus for delivering the products to the ground surface. The structure of this invention allows closing of the tunnel between retorts to allow isolation of retorts in which men are working from products produced in a retort in which retorting is in progress. Doorways in the exhaust tunnel are engaged by a door that can be moved from one doorway to the next to seal against the doorway to close the tunnel. In a preferred embodiment, two movable doors are provided in the exhaust tunnel to allow pressurization of a rubblized retort between a retort in which retorting is in progress and a retort in which mining is in progress. Preferably, the exhaust tunnel is provided with a trench for draining liquid products produced in the retorting. A liquid seal under the doorways provides a continuation of the trench past the doorways without allowing flow of gas past the doorway.

DESCRIPTION OF PREFERRED EMBODIMENT

Figure 1:
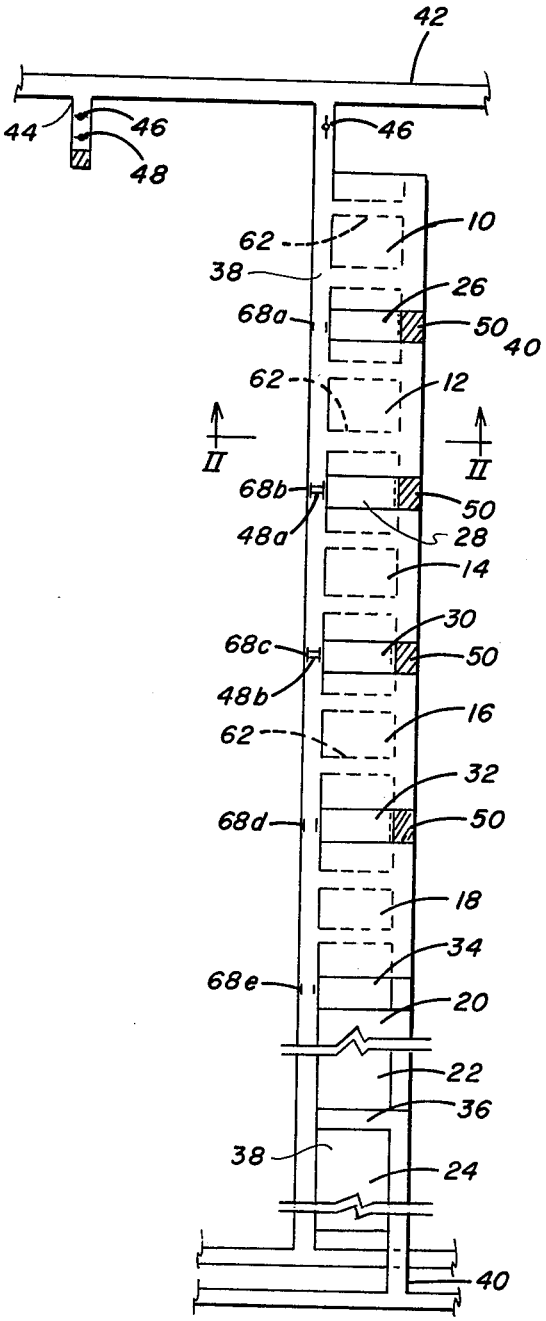
FIG. 1 is a horizontal sectional view of a row of retorts taken along section line I—I in FIG. 2.

For convenience in description, this invention will be described for use in the in-situ retorting of oil shale. Referring to FIG. 1 of the drawings, a row of in-situ retorts 10, 12, 14, 16, 18, 20, 22 and 24 in a subsurface oil shale deposit are separated by end pillars 26, 28, 30, 32, 34 and 36. During the construction of the retorts and preferably before initiating the in-situ combustion in any of the retorts, an exhaust tunnel 38 is driven below one side of the retorts for the length of the row at or slightly below the level of the bottom of the retorts. A withdrawal drift 40 is driven parallel to the exhaust tunnel at the opposite side of the retorts. The exhaust tunnel and withdrawal drift are used in the mining and hauling of shale and for ventilation during construction of the retorts, and it is for that reason the exhaust tunnel and withdrawal drift are preferably driven for the length of the tunnel before beginning combustion in any of the retorts.

Exhaust tunnel 38 extends beyond retort 10 to a collection tunnel 42 through which products of the retorting are delivered, preferably to a separator, not shown, before delivery to the surface. Flow in the tunnel 38 is toward collection tunnel 42. In the description, the direction toward tunnel 42 is referred to as downstream and the direction away from tunnel 42 is referred to as upstream. A plurality of collars 44 are driven from the collection tunnel 42 at intervals along its length for connection to exhaust tunnels from rows of retorts to be constructed later. A stationary door 46 that can be opened or closed by remote control and a movable door 48 of the type to be described hereinafter is installed in each collar before the beginning of in-situ combustion in any retort that delivers products into collection tunnel 42. Each of the collars 44 is sealed with fill behind the doors 48. After rubblization of a retort is completed, the withdrawal drift 40 is sealed as indicated by seals 50 between that retort and the adjacent retort in which mining or rubblization activities are continuing.

The retorts shown in FIG. 1 are in various stages of operation. Combustion has been completed in retort 10, burning is progressing in retort 12, retort 14 has been rubblized and is pressurized with air, retort 16 is in the process of being rubblized, and retort 18 is in a stoping phase preparatory to rubblization. Retorts 20, 22 and 24 have yet to be constructed. Eight retorts have been shown in the row served by tunnel 38, but that number is only for illustration of the invention. Either more or fewer retorts can be in the row.

Figure 2:
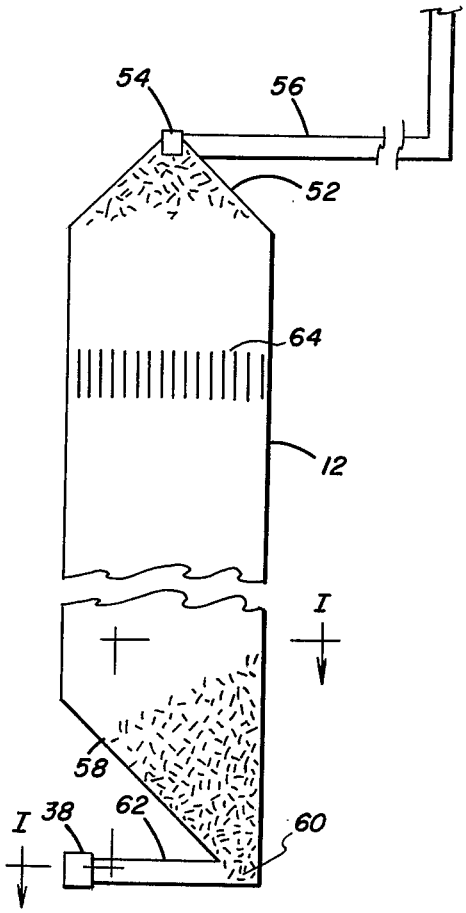
FIG. 2 is a vertical transverse sectional view through one form of a rubblized in-situ retort taken along section line II—II in FIG. 1.

The retort shown in FIG. 2 is of a preferred configuration in which the exhaust tunnel is laterally displaced from the retort outlet. The retort is of a rectangular horizontal section and typically may have a width of 150 feet and a length of 300 feet. The height of the retort will, of course, depend on the thickness of the oil shale deposit. In the Piceance Creek region of Colorado, the thickness of the shale deposits is such that the retorts may be 700 feet or more in height. The roof 52 of the retorts slopes upwardly from the sides to an apex tunnel 54. Air for the combustion operation is delivered into the apex tunnel 54 through an air supply tunnel 56. The bottom 58 of the retort slopes downwardly from the lower end of one side to an outlet 60 at the bottom of the opposite side that communicates with a plurality of product drifts 62 that extend laterally from the outlet to the exhaust tunnel 38. Exhaust tunnel 38 must be unobstructed to allow movement of the doors as the retorting progresses in series to upstream retorts. If the exhaust tunnel is directly below the outlet of the retorts, means must be provided to prevent shale falling into the exhaust tunnel where it would prevent the movement of the doors as required for retorting in the upstream retorts. Retort 12 is shown in FIG. 2 in the burning stage with a combustion front 64 indicated schematically by a plurality of vertical lines.

Figure 4:
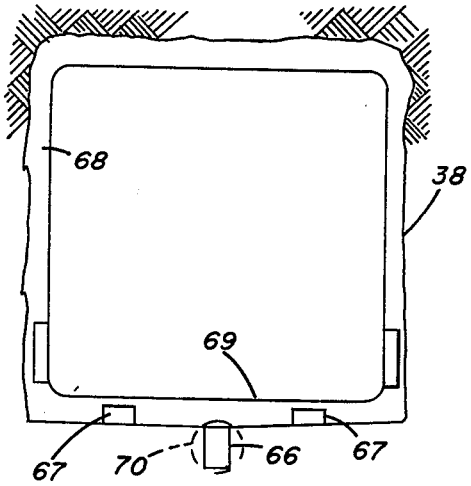
FIG. 4 is a vertical, transverse sectional view of the exhaust tunnel.

The exhaust tunnel 38 slopes downwardly at a slight angle such as 3 to 8 degrees from retort 24 to the collection tunnel 42 to facilitate drainage to the collection tunnel of any liquid products that collect in the exhaust tunnel. As is best shown in FIG. 4 of the drawings, the bottom of the exhaust tunnel 38 also slopes downwardly at a slight angle from its sides to a trench 66 in which liquids collect and drain to the collection tunnel 42. Trench 66 minimizes contact between liquids and gases in exhaust tunnel 38, thereby minimizing entrainment of liquids in the gases, and connects with a similar trench, not shown, in tunnel 42. Extending longitudinally of the exhaust tunnel 38 are parallel runways 67 that provide a smooth surface slightly above the floor of the tunnel 38 over which the doors can be skidded, as hereinafter described. Transverse drains through, or short gaps in, the runways are provided to allow oil to drain to trench 66. Located at intervals in the exhaust tunnel 38 at positions to allow isolation of each retort from an adjacent retort are doorways 68. The doorways 68 are preferably located where the exhaust tunnel penetrates the pillars 26, 28, 30, etc. between adjacent retorts because of the increased stability at the pillars as compared to under the retorts. The doorways could be located at any place in the exhaust tunnel 38 between the upstream product drift 62 of one retort and the downstream product drift 62 of the adjacent upstream retort.

Figure 6:
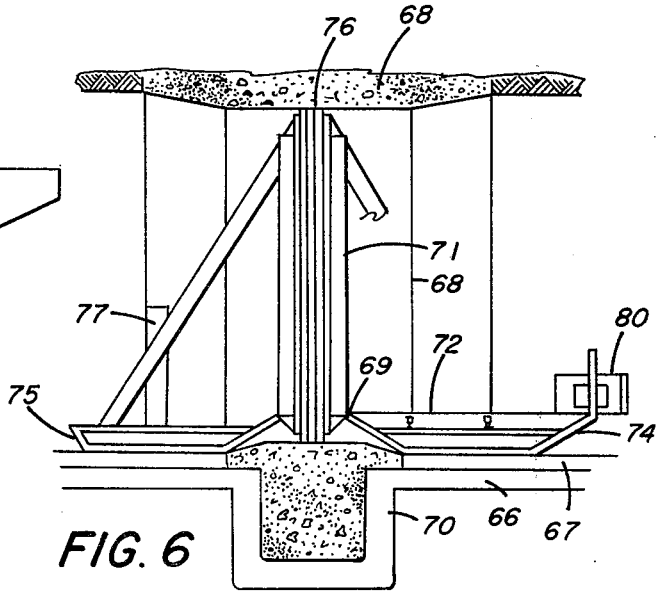
FIG. 6 is a schematic view, partially in vertical section, of a movable door in position in a doorway.

The doorways 68 are essentially concrete collars that extend inwardly from the wall around the periphery of the exhaust tunnel to provide a smooth surface that permits a tight seal to prevent flow of gaseous combustion products from a retort in the process of burning to the adjacent rubblized retort, as hereinafter described. The collars preferably extend inwardly for approximately one foot from the walls of the exhaust tunnel to provide adequate clearance between the tunnel walls and the doors 48 to allow movement of the doors through tunnel 38. For example, if an exhaust tunnel is 22 feet wide by 20 feet high, the opening of the doorway can be 20 feet in width and 18 feet high. The sill 69 of the doorway is slightly, for example ½ inch to 1 inch, above the upper surface of the runways 67. To provide a continuation of the trench 66, an oil drain seal 70 extends from the trench 66 on one side of the doorway under the doorway to the trench 66 on the other side of the doorway, as is best shown in FIG. 6 of the drawings. Seal 70 has a suitable depth, for example 12 feet, to provide a seal that will not be blown out at the pressure differentials across the doorway that are likely to be encountered. The diameter of the seal 70 should be larger than the width of the oil drain to eliminate the possibility of blockage by debris carried into the oil from the oil drain.

As is best shown in FIG. 6, the doors 68 consist essentially of a barricade 71 mounted on a sled 72 that is adapted to be pulled through tunnel 38 by a tugger hoist. The sled 72 has a a pair of spaced-apart front runners 74 and rear runners 75 positioned to skid on the runways 67 as the door is moved from one doorway to the next. Extending around the barricade 71 portion of the door are a plurality of inflatable sealing rings 76 of rubber or other flexible material which, for example, may be expanded by gas or hydraulic pressure from a relaxed height of three inches to an expanded height of six inches to engage the surface of the doorway to provide the necessary seal. Doors 48 are provided with bumpers 80 at their upstream end for engagement with guide plates 77 in the doorways to center the doors in the doorways. While a door at the doorway immediately upstream of the retort in which retorting is in progress would suffice to close the exhaust tunnel to upstream flow of combustion products, it is also desirable to use the doors to isolate a retort adjacent a retort in which burning is in progress to permit pressurization of that retort. Two doors 48 in the exhaust tunnel 38, one at each end of the pressurized retort, allow the desired pressurization. The two doors are essentially identical except that the downstream door designated as **48*a* will be exposed to hot combustion products and must be cooled. A coolant is circulated through that door from the upstream door designated as 48*b*. Similarly, means for controlling the seals 76 in door 48*a* and for moving door 48*a* are operated from upstream of door 48*b*** and pass through that door.

Figure 3:
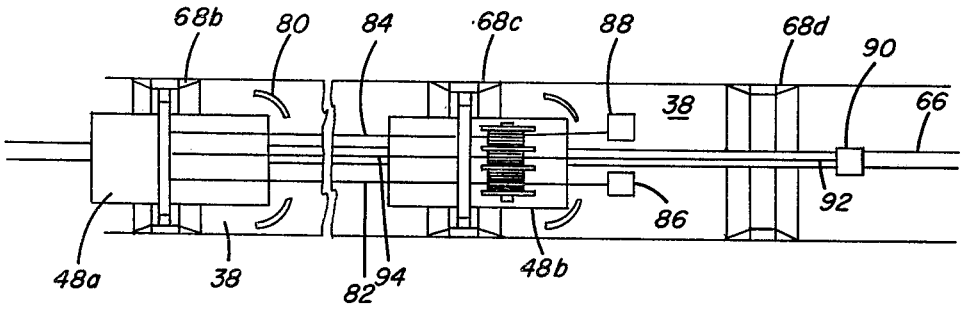
FIG. 3 is a schematic plan view of the exhaust tunnel with doors in place in two doorways.
Figure 5:
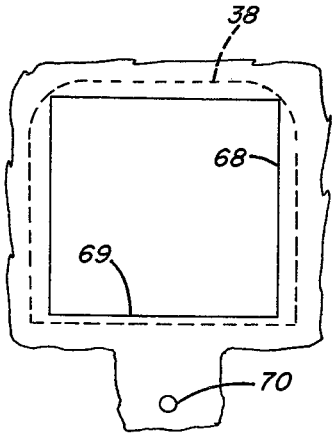
FIG. 5 is a vertical, transverse sectional view of a doorway.
Figure 7:
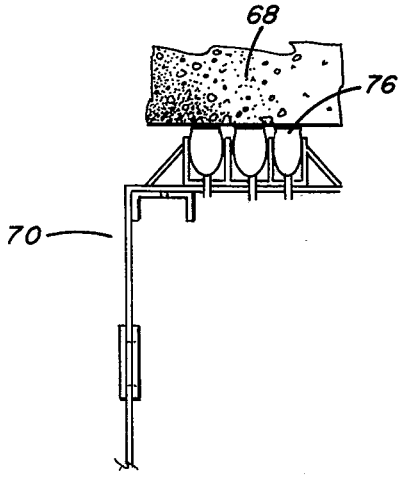
FIG. 7 is a fragmentary schematic view of seals for preventing flow between the door and the doorway.

Referring to FIGS. 1 and 3, doorways adjacent pillars 26, 28, 30, and 32 are indicated by reference numerals 68*a*, 68*b*, 68*c* and 68*d* for convenience in the description of the operation of this invention. The doorways can be constructed at any time up to the pressurization of an adjacent retort. Door 48*a* is shown in the exhaust tunnel 38 in doorway 68*b* at pillar 28 and the door 48*b* is shown in tunnel 38 at doorway 68*c* adjacent pillar 30. The portion of tunnel 38 upstream of door 48*b* will be exposed to a substantially atmospheric environment in which men can work. That portion of the tunnel between the two doors 48*a* and 48*b* will contain air under pressure and that portion of the tunnel opposite retorts 10 and 12 will contain combustion products. To cool the door 48*a* that is exposed to the combustion products, a cooling medium circulating means indicated by line 82 extends from door 48*b* to door 48*a*, as is shown in FIG. 3. Similarly, pneumatic or hydraulic fluid supply means indicated by line 84 extend from door 48*b* to door 48*a* to supply air for expanding seal 76 in door 48*a*. The single lines 82 and 84 are diagrammatic representations and can designate conduits for delivery of fluids to door 48*a* and returning the fluids to door 48*b*. Cooling medium circulating means 82 is connected with a suitable supply of cooling medium indicated by 86 to the right of door 69*b* in FIG. 3. Similarly, means for supplying fluid to inflate the sealing means 76 are indicated by 88 located in the exhaust tunnel 38 upstream of door 69*b* in FIG. 3. Valves, pumps and switches needed to control flow in lines 82 and 84 are provided and considered to be included in 86 and 88. Means, not shown in the drawing, are provided in door 48*b* sealing around lines extending from door 48*b* to door 48*a* to prevent leakage through the door. A tugger hoist 90 movably located in tunnel 38 upstream of door 48*b* in FIG. 3 is connected to that door by a cable 92. An extension 94 of cable 92 is connected to door 48*a* for movement of that door, as hereinafter described.

In the operation of this invention, tunnel 38 is driven to connect with the collection tunnel 42. If the row of retorts shown in FIG. 1 is not the first row of retorts to produce products delivered into collection tunnel 42, exhaust tunnel 38 will be driven to connect with a previously constructed collar similar to collars 44. Remote-controlled door 46 is opened. For the first retorting in the row of retorts, door 48*a* is moved to close the doorway 68*a* immediately upstream of retort 10 and door 48*b* is moved into doorway 68*b* before ignition of retort 10. The oil drain seal in each of the doorways is filled with liquid before the door is in place.

The retorting of the oil shale in the retorts is conducted by conventional techniques. If in-situ combustion is used to supply the heat necessary to retort the oil shale, a fuel and air are injected into the top of the retort and the fuel is ignited. Injection of the fuel and air are continued until the oil shale is ignited and thereafter the injection of the fuel is discontinued but the flow of air is continued. A combustion front such as 64 is developed. Hot gases from the combustion front flow downwardly through oil shale below the combustion front to heat the shale to a temperature such as 800° F. to 1000° F. at which kerogen in the oil shale is converted to shale oil. A carbonaceous residue is left on the oil shale immediately below the combustion zone. That residue serves as the fuel burned in the combustion zone. Shale oil and gaseous combustion products flow downwardly through the retort to its outlet and then through the product drifts 62 to the exhaust tunnel 38 for delivery to the collection tunnel 42.

Assuming, for purposes of description, that, as shown in FIGS. 1 and 3, retort 10 is spent and retort 12 is burning, door 48*a* will be in doorway 68*b* adjacent pillar 28 and door 48*b* will be in doorway 68*c* adjacent pillar 30. The doors 48*a* and 48*b* are positioned in the doorway with the front and rear runners straddling the sill of the doorway to allow the seals to engage the sill. Contraction of the seals on deflation provides adequate clearance for moving the doors through the doorway. After completion of the burning in retort 12, the seals on door 48*b* are deflated and that door is pulled by tugger hoist 90 and cable 92 to a position in doorway 68*d*. During the movement of door 48*b*, door 48*a* remains closed in doorway 68*b*. To allow movement of door 48*b* independently of door 48*a*, it is necessary that the lines 82 and 84 and cable 94 have slack between their connection to door 48*b* and their connection to door 48*a* as the distance between the doors will be doubled during the movement of the doors. When door 48*b* is in position in doorway 68*d*, the seals in doors 48*b* are expanded and thereafter the seals on door 48*a* are released and door 48*a* moved to position in doorway 68*c*. The seals in door 48*a* are then expanded, after which retort 16 is pressurized and burning is commenced in retort 14. The procedure is repeated after burning is completed in each retort to move the doors to retorts successively farther from the collection tunnel until all of the retorts in the row have been retorted. After retorting has been completed in retort 22, door 48*b* will be removed from the tunnel 38, door 48*a* will be moved to a doorway in tunnel 38 at the upstream end of retort 24, and a seal similar to seal 50 constructed on the upstream side of door 48*b*. Retort 24 will then be retorted in the manner described above.

It has been proposed that the retorting of oil shale be conducted under a pressure ranging from a slight vacuum to a pressure exceeding atmospheric pressure. In either type of operation, the large area of the doors 48 may generate a large force tending to move the doors in the exhaust tunnel even though the pressure differential across the door is low. If the force exerted by the seals 76 against the doorway and the weight of the door is believed not to be adequate to hold the doors in place, locking means can be provided to prevent movement of the doors.

Figure 8:
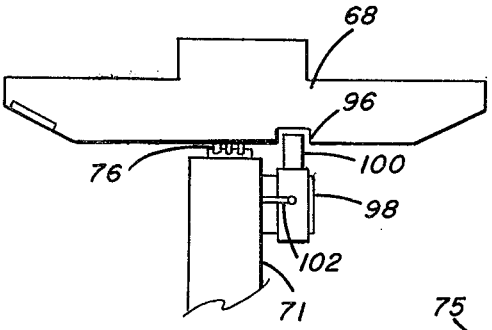
FIG. 8 is a schematic view of apparatus for locking the doors in place in a doorway.

Referring to FIG. 8 of the drawings, an embodiment of this invention is shown in which a notch 96 is provided in the doorway. Mounted on the door 48 is a cylinder 98 in which a piston 100 is slidable. A hydraulic or pneumatic fluid supply line 102 extends from the barricade 70 of the door to move the piston 100 as desired. For example, piston 100 may be urged by a spring toward an extended position engaging notch 96 and moved into a retracted position by a fluid supplied by line 102. When the door is moved into position for sealing against the doorway, the spring will move piston 100 into notch 96. When it is desired to move the door to the next doorway, a fluid under pressure is supplied to cylinder 98 to retract piston 100, the seals 76 deflated, and the door moved to the next doorway. When the door is adjacent the next doorway, the pressure within cylinder 98 will be released and the piston 100 moves outwardly into the notch 96 to lock the door in position. A single notch 96 and piston 100 have been shown in FIG. 3. Preferably a plurality of such pistons will extend into a notch 96 that extends around the doorway or into individual notches located at intervals around the door.

This invention allows the use of a single tunnel to deliver products of in-situ retorting in a bank of retorts. It also permits retorting, mining and rubblization to proceed simultaneously in retorts connected to a single exhaust tunnel. The preferred embodiment further allows maintenance of a rubblized retort between retorts in which combustion is in progress and retorts in which men are working at a higher pressure than in either of such retorts to provide a positive gas pressure barrier to prevent leakage of combustion products through fissures or fractures in the oil shale deposit to retorts in which men are working as well as through the exhaust tunnel.

This invention has been described for the in-situ retorting of oil shale by combustion in an in-situ retort of a portion of the organic material in the oil shale, but is not limited to such use. The invention has utility wherever in-situ retorting of a carbonaceous deposit, which may be a heavy crude oil in a formation of low permeability or coal as well as oil shale, is conducted in a plurality of retorts connected to a common exhaust tunnel into which products of the retorting are discharged.

We claim:

1. Apparatus for isolating a retort for the in-situ retorting of carbonaceous deposits from an adjacent retort in a row of retorts, each retort having an outlet at its lower end, and delivering products from the in-situ retorting in the retorts to a collection tunnel, comprising an exhaust tunnel communicating with the outlets of the retorts extending longitudinally of the row of retorts at a level below the outlet of the retort to provide communication between each of the retorts and the collection tunnel, a doorway in the exhaust tunnel between adjacent retorts, said doorway extending inwardly from the walls of the exhaust tunnel around the periphery thereof to provide a sealing surface, a door movable in the exhaust tunnel from one doorway to an adjacent doorway, an expandable seal around the periphery of the door adapted to engage the doorway, means for introducing a fluid into the sealing means to expand the sealing means against the doorway, and means for moving the door from a doorway to an adjacent upstream doorway.

2. Apparatus as set forth in claim 1 characterized by means for circulating a coolant in the door, and coolant recirculating means located upstream of the door for supplying cold coolant to the coolant circulating means in the door.

3. Apparatus as set forth in claim 1 characterized by a trench extending longitudinally of the exhaust tunnel in the floor thereof, said doorways closing the tunnel, and a U-shaped conduit under each of the doorways extending from the trench on one side of the doorway to the trench on the other side of the doorway, said U-shaped conduit extending below the doorway a depth adequate to provide a liquid seal preventing flow of gas through the conduit.

4. Apparatus as set forth in claim 1 characterized by the exhaust tunnel sloping downwardly at a slight angle toward the collection tunnel.

5. Apparatus for in-situ retorting of carbonaceous deposits successively in in-situ retorts arranged in a row with end pillars separating adjacent retorts in the row, said retorts having an outlet at the lower end therof, the retorting beginning in the retort at one end of the row and terminating in the retort at the opposite end of the row, comprising an exhaust tunnel extending longitudinally of the row of retorts below the level of the outlet thereof, a product drift extending from the outlet of each retort laterally to the exhaust tunnel, a doorway in the exhaust tunnel between adjacent product drifts of adjacent retorts, said doorways extending inwardly from the walls of the tunnel around the periphery thereof to provide a smooth sealing surface, a first door in the doorway between the retort in which retorting is in progress and the adjacent upstream retort, a second door in the doorway between said adjacent upstream retort and the next upstream retort, said first door and second door having expandable sealing means around the peripheries thereof for engagement with the doorways to close the exhaust tunnel, means operable from upstream of the second door for expanding and contracting the sealing means in the first door and the second door, and means upstream of the second door for pulling the first door and the second door to the next upstream doorway.

6. Apparatus as set forth in claim 5 characterized by means for circulating a coolant through the first door and means controllable from upstream of the second door for delivering the coolant to said means for circulating.

7. Apparatus as set forth in claim 5 characterized by the means for pulling the door being a tugger hoist in the exhaust tunnel upstream from the second door, a cable from the tugger hoist to the first door for moving the first door from one doorway to the adjacent upstream doorway, said cable passing through said second door to the first door, and means for connecting the cable to the second door for moving the second door.

8. Apparatus as set forth in claim 7 characterized by the means on the second door for connection of the cable to the second door being releasable to permit movement of the first door independently of the second door.

9. Apparatus as set forth in claim 5 characterized by means for moving the first door and the second door independently of one another from one doorway to the adjacent upstream doorway.

10. Apparatus as set forth in claim 5 characterized by a trench running longitudinally in the floor of the exhaust tunnel for the delivery of liquid products from the retorts, said doorways closing the trench, a U-shaped conduit communicating with the trench on each side of the doorway extending under the doorway to provide a seal.

11. Apparatus as set forth in claim 5 characterized by the doors being mounted on sleds for movement through the exhaust tunnel and guide bumpers on the upstream end of the sleds for centering the doors in the doorways.

12. Apparatus as set forth in claim 11 characterized by a pair of spaced-apart parallel runaways extending longitudinally of the exhaust tunnel above the level of the floor of the tunnel, runners on the sled positioned to move along the runway, and the bottom of the doorway extending across the tunnel at a height above the runway to provide a continuous smooth sealing surface around the periphery of the tunnel at the doorway and allow the sled to be pulled through the doorway.

13. Apparatus as set forth in claim 5 characterized by releasable locking means on the first door adapted to engage the doorway to prevent downstream movement of the first door, and releasable locking means on the second door adapted to engage the doorway and prevent upstream movement of the second door.

14. Apparatus as set forth in claim 13 characterized by the locking means on the first door being a pawl adapted to engage a slot in the doorway to prevent downstream movement of the door.

15. Apparatus as set forth in claim 5 characterized by the means for expanding and contracting the sealing means including a control fluid delivery line extending from the first door to the second door and control means upstream of the second door adapted to control flow of control fluid to expand and contract the seals around the doors.

* * * * *